US006203445B1

(12) United States Patent
Rhodes et al.

(10) Patent No.: US 6,203,445 B1
(45) Date of Patent: Mar. 20, 2001

(54) GOLF PUTTER HEAD

(75) Inventors: Bobby R. Rhodes, Glenpool; James P. Niedermeyer, Tulsa, both of OK (US)

(73) Assignee: Vertex, L.L.C., Tulsa, OK (US)

( * ) Notice: Subject to any disclaimer, the term of this patent is extended or adjusted under 35 U.S.C. 154(b) by 0 days.

(21) Appl. No.: 09/375,236

(22) Filed: Aug. 16, 1999

Related U.S. Application Data

(60) Provisional application No. 60/133,767, filed on May 12, 1999.

(51) Int. Cl.[7] ..... A63B 69/36

(52) U.S. Cl. ..... 473/251; 473/254

(58) Field of Search ..... 473/240, 242, 473/238, 231, 223, 251, 340, 341, 254, 252, 253

(56) References Cited

U.S. PATENT DOCUMENTS

| | | | |
|---|---|---|---|
| D. 235,668 | | 7/1975 | Swash . |
| D. 399,911 | | 10/1998 | Nicolette et al. . |
| 1,250,296 | | 12/1917 | Stanton . |
| 3,019,022 | * | 1/1962 | Ehmke . |
| 3,064,975 | | 11/1962 | Smith . |
| 3,770,279 | | 11/1973 | Phinny . |
| 4,077,633 | * | 3/1978 | Studen . |
| 4,240,636 | | 12/1980 | Swenson . |
| 4,836,550 | | 6/1989 | Kobayashi . |
| 4,953,866 | * | 9/1990 | Bang . |
| 4,984,799 | | 1/1991 | Finney . |
| 5,348,301 | * | 9/1994 | Ma . |
| 5,441,272 | | 8/1995 | Artola . |
| 5,676,606 | | 10/1997 | Schaeffer et al. . |
| 5,692,968 | | 12/1997 | Shine . |
| 5,728,007 | * | 3/1998 | Eakin . |
| 5,782,705 | | 7/1998 | Solari . |
| 5,816,930 | * | 10/1998 | Brown . |
| 5,846,140 | * | 12/1998 | Hoburg . |

* cited by examiner

*Primary Examiner*—Sebastiano Passaniti
(74) *Attorney, Agent, or Firm*—Head, Johnson & Kachigian

(57) ABSTRACT

A golf putter incorporating an inclined alignment face located behind and angularly displaced from a golf putter striking face. A first face, the putter striking face, makes actual contact with the golf ball while a second face, the inclined alignment face, aides the golfer in aligning the putter with the intended path that the golf ball will take after being struck by the putter.

6 Claims, 3 Drawing Sheets

GOLF PUTTER HEAD

REFERENCE TO PENDING APPLICATIONS

This application claims priority to U.S. Provisional Application No. 60/133,767 filed May 12, 1999, entitled GOLF PUTTER HEAD.

REFERENCE TO MICROFICHE APPENDIX

This application is not referenced in any microfiche appendix.

TECHNICAL FIELD OF THE INVENTION

This invention relates to the field of golf clubs and in particular, to an improved golf putter head which incorporates an inclined alignment face to simplify the alignment of the golf putter striking face with the intended path of the golf ball.

BACKGROUND OF THE INVENTION

Golf clubs and the head portions of golf clubs are well known in the art. The face of each golf club is the part that is used to strike, or hit, the golf ball. Primarily, golf clubs vary with respect to the angled pitch of the club head's striking surface. Other, less distinct, club variances include weight mechanisms, shaft length variances, gripping surface designs and materials, striking face size and almost any other concept promising to effectuate golf ball travel along an intended path and/or trajectory.

A very specific type of golf club is referred to as a "putter". A golfer employs a putter by: first, sighting the ball and club relative to the ball's ultimate destination; second, drawing the putter backward in a motion away from the ball; and, third, swinging the putter forward such that the striking surface of the putter head makes contact with the golf ball imparting momentum and propelling the ball forward along its anticipated path toward its ultimate destination.

Numerous and varied sighting alignment devices have been disclosed in the past to help the golfer in aligning a golf putter striking face, a golf ball and the golf ball's intended path. Examples of a putter head employing sighting indicia for alignment purposes can be found in U.S. Pat. No. 5,816,930 to Brown and references cited therein. Brown provides a series of descending stepped surfaces which extend from the face downward and away from, or towards the rear of, the putter head. However, while the above cited references introduce and disclose a number of noteworthy advances and technological improvements, none completely fulfill the specific objectives achieved by the instant invention.

It is, therefore, an objective of this invention to incorporate a second, inclined alignment face located directly behind, but on an angle to, the putter head or striking face. The first face, the putter head face, makes actual contact with the ball while the second inclined face aides in assisting the golfer with respect to the alignment of the putter with the intended path of the golf ball.

It is another object of this invention to cause the second or inclined face to represent a false face that is slanted back from the golf putter striking face at an angle varying from between 1° to 89°, said angle thereby allowing the slanted face to create a perspective for and to be viewed by the golfer for the purpose of aligning the golf putter striking face with the intended path of the golf ball.

It is yet a further objective of the instant invention to introduce a sense of consistency when utilizing a putter and other golf clubs within the golfer's arsenal. That is, the golf club putter's inclined alignment face simulates the face of non-putting instruments used by golfers.

BRIEF SUMMARY OF THE INVENTION

The present invention is directed to an improved golf club putter. The putter includes both a striking face and, immediately behind and adjacent the striking face, an inclined face to aid in the aiming of the putter. The striking face rises substantially perpendicular to the horizontal base, or bottom of the golf club putter, while the alignment face slants backward from the vertical striking face on an incline varying between 1° to 89°, said incline to facilitate the purpose of aligning the golf putter striking face with the golf ball's intended path.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

While the making and using of various embodiments of the present invention are discussed in detail below, it should be appreciated that the present invention provides for inventive concepts capable of being embodied in a variety of specific contexts. The embodiments discussed herein are merely illustrative of specific manners in which to make and use the invention and are not to be interpreted as limiting the scope of the instant invention.

The specification describes the invention and the same terms applied in prior art may be broader in meaning than employed herein. Whenever there is a question between the broader definition of such terms used in the prior art and the more specific use of the terms herein, the more specific meaning should be assumed.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification. The general features of the improved golf putter head are described and disclosed in association with accompanying FIGS. 1 through 5B. So that the manner in which the above recited features, advantages and objects of the present invention can be understood in detail, more particular description of the invention briefly summarized above may be had by reference to the embodiments thereof illustrated in the appended drawings. In all the drawings identical numbers represent the same elements.

Figure 1:
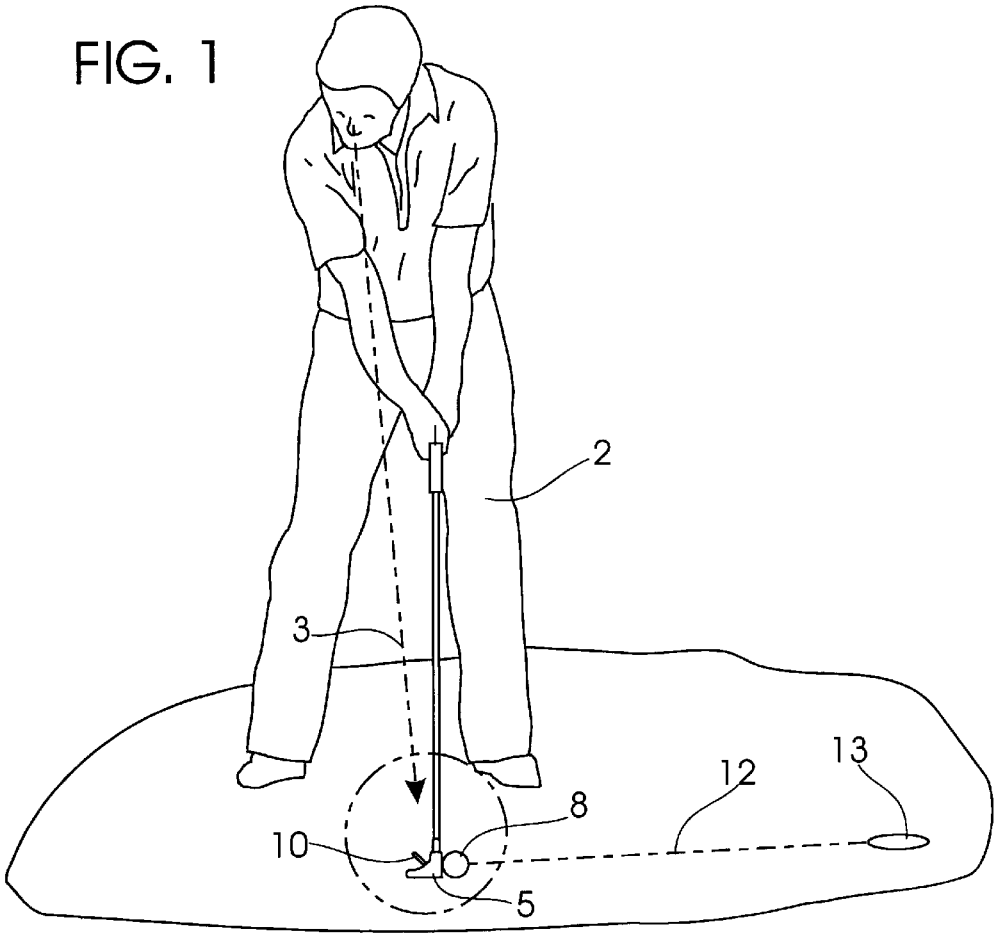
FIG. 1 is an illustration depicting use by a golfer of the instant invention.

Turning now to FIG. 1, to employ the instant invention, a golfer 2 assumes a conventional putting stance and aligns the putter head 5, a golf ball 8, the golf ball's intended path 12 (shown by dashed line), and the golf hole 13. The golfer's sighting reference 3 (illustrated by arrow) is aided by the second inclined face 10 each time the golfer 2 initiates the putting alignment process. A more detailed and enlarged view of the second alignment face 10 is provided in FIG. 2.

Figure 2:
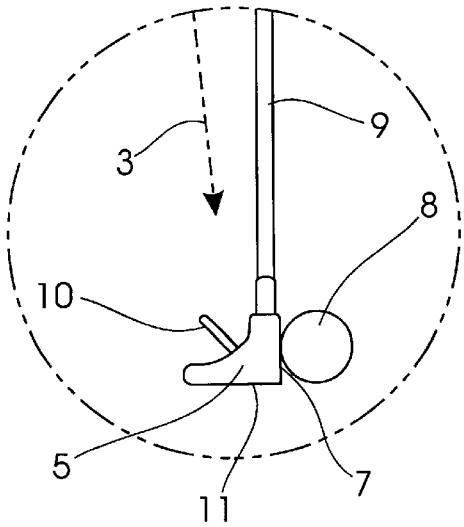
FIG. 2 is an illustration depicting use of the instant invention, providing an enlarged and closer view detail of the golf putter head and alignment means.

Referring now to FIG. 2, it provides a more detailed illustration of alignment components and discloses the golf putter shaft 9, the golf putter base or bottom 11, a golf ball 8, golf putter's striking face 7, the golf putter's second, inclined alignment face 10 and the golfer's sighting reference 3. The golfer's sighting reference 3 is drawn to and focused upon the second inclined face 10 which simulates the inclined face of any number of "irons" in the golfer's arsenal and helps to create a visual perspective assisting the golfer in aiming the putter head in the intended direction in which the golf ball is to be struck. The present invention, thus, will make the golfer more comfortable with use of the putter.

The inclined face 10 provides for fixation at an angular displacement between 1° and 89° of the striking face of the putter 7. Stated in other words, an angle formed by a plane of the inclined face 10 and a plane of the striking face 7 forms an acute angle. By way of example but not limitation, an angle between 35° to 50° has been found to be preferred.

Such variance in the angular displacement of the second inclined face allows for optimal second face positioning by a golfer. Optimal positioning, in turn, is often predicated upon the golfer's height, the offset angle of a golf putter shaft 9, or indeed, even a golfer's preferred position with respect to the shaft putter head 5 and ball 8. Flexibility in the design and utilization of the improved golf putter head 5 and more specifically the inclusion of the second inclined face 10, can be accommodated in any number of embodiments.

Figure 3:
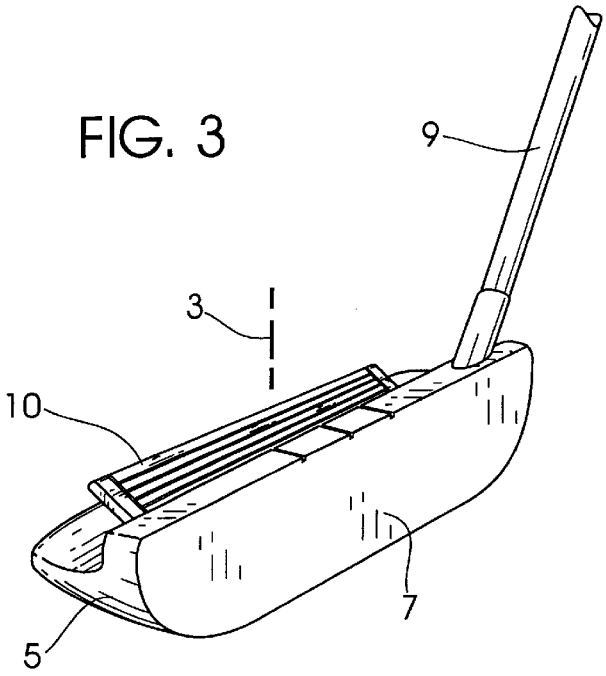
FIG. 3 illustrates a perspective view of the preferred embodiment of the instant invention.
Figure 4:
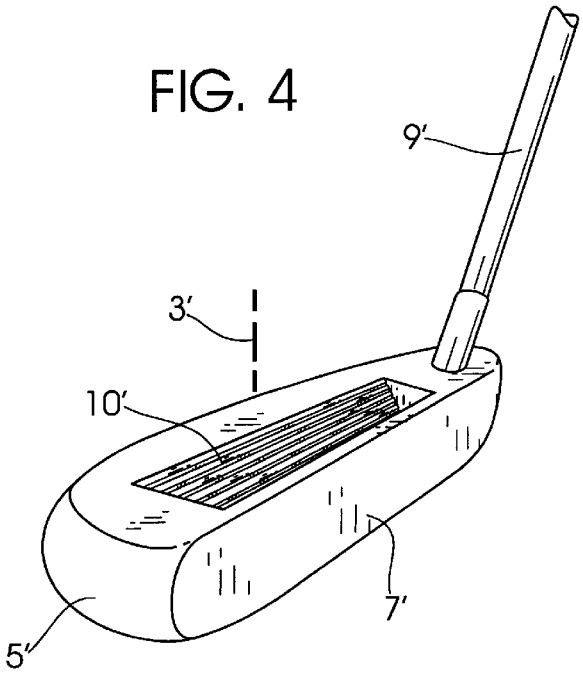
FIG. 4 illustrates an alternate embodiment of the instant invention.
Figure 5:
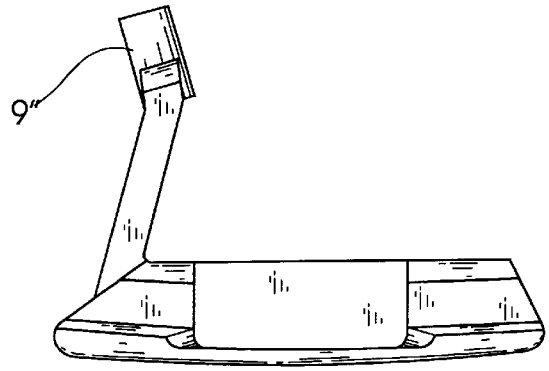
FIG. 5 illustrates a second alternate embodiment of the instant invention.

FIGS. 3 through 5 illustrate a more full and detailed disclosure of such embodiments.

Figure 3A:
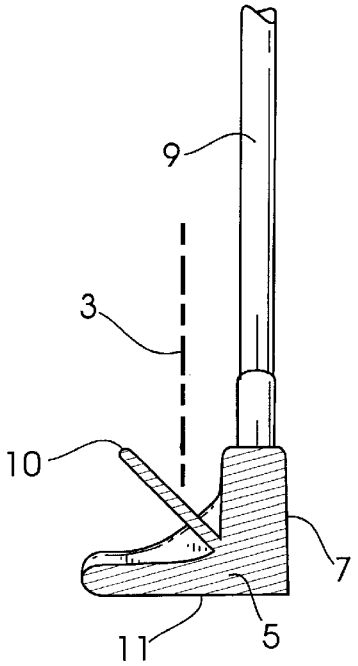
FIG. 3A is a part cross-sectional view of the instant invention's preferred embodiment.

FIG. 3 illustrates the improved putter head 5, striking face 7, golfer's sighting reference 3, golf club shaft 9 and the second inclined alignment face 10 in a semi-open club head design when viewed from a head-on perspective. FIG. 3A provides a cross-sectional illustration of that head-on perspective where again 9 represents the putter shaft, 11 the golf putter base or bottom, 7 represents the putter striking face, 3 the golfer's sighting reference, 5 the golf putter head, and 10 the second inclined alignment face. If the striking surface forms a first plane and the putter base or bottom formed a second plane, the intersection of the planes would form a first angle. It will be appreciated that the putter base or bottom 11 is substantially vertical to the striking face 7. If the inclined sighting surface 10 formed a third plane which extends from either the first or second planes, the second angle formed thereby would be less than the first angle.

Figure 4A:
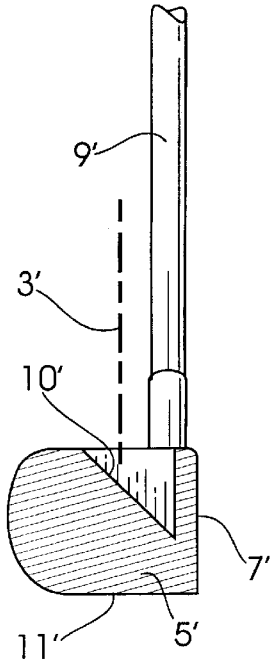
FIG. 4A is a part cross-sectional view of the alternate embodiment illustrated in FIG. 4.

Turning now to FIG. 4, an alternate embodiment is shown. FIG. 4 depicts a closed club faced embodiment illustrating the putter striking face 7', putter shaft 9', golfer's sighting reference 3', second inclined alignment face 10', and improved putter head 5'. FIG. 4A provides a cross-sectional diagram of the closed putter head embodiment from a head-on direction, illustrating again the putter striking face 7', putter shaft 9', golf putter base or bottom 11', golfer's sighting reference 3', second inclined alignment face 10', and improved putter head 5'. The inclined alignment face 10' is recessed into the body of the head 5'.

Figure 5A:
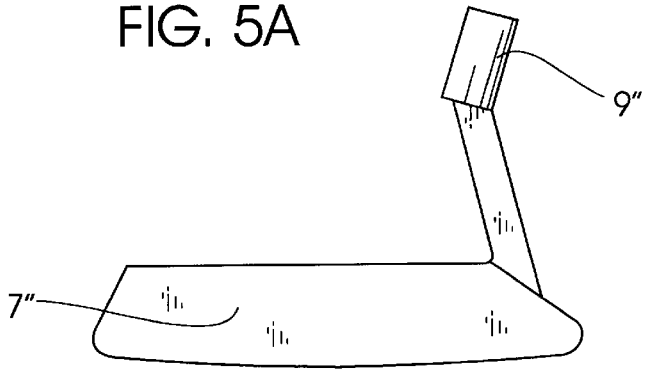
FIG. 5A illustrates a reverse side or striking face view of the second alternate embodiment illustrated in FIG. 5.
Figure 5B:
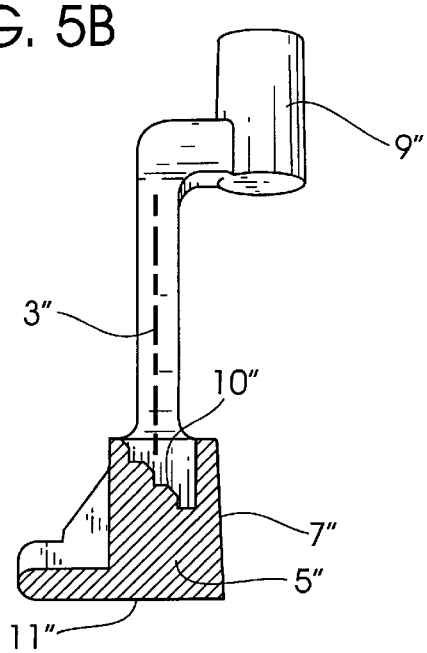
FIG. 5B is a part illustration, part cross-sectional view of the second alternate embodiment illustrated in FIG. 5.

Turning now to FIG. 5, a further alternate embodiment is shown. FIG. 5 illustrates the present invention with an offset putter shaft 9. FIG. 5A shows the same embodiment of FIG. 5 from a putting striking face 7" perspective and illustrates an offset putter shaft 9". FIG. 5B lastly depicts a cross-sectional view of the invention's alternative embodiment showing second inclined alignment face 10", putter head 5", putter striking face 7", golf putter base or bottom 11", and offset putter shaft 9". In the embodiment of FIGS. 5, 5A and 5B, the inclined alignment face is incremented with a plurality of notches.

The inclined sighting surface forms a three dimensional perspective to visually assist the golfer.

Having disclosed and described the instant invention, it is clear one such embodiment of the instant invention would be represented as a golf club comprising: a vertically oriented striking surface; an inclined sighting surface adjacent to and facing toward said vertically oriented striking surface. Additionally, the golf club's inclined sighting surface would be angularly displaced from the golf club head's horizontal axis. Such angular displacement would occur within a range of 1° to 89° from said axis.

While this invention has been described in reference to illustrative embodiments, this description is not to be construed in a limiting sense. Various modifications and combinations of the illustrative embodiments as well as other embodiments of the invention will be apparent to those skilled in the art upon referencing this disclosure. It is therefore intended this disclosure encompass any such modifications or embodiments.

What is claimed is:

1. A golf club having a golf putter head, which head comprises:

a striking surface substantially vertically oriented to a base;

an inclined sighting surface adjacent to and facing toward said vertically oriented striking surface, said inclined sighting surface incremented with a plurality of notches, each notch generally parallel with said base or said striking surface, wherein a plane formed by said striking surface and a plane formed by said inclined sighting surface form an acute angle with a range between 1° and 89°.

2. A golf club as set forth in claim 1 wherein said inclined sighting surface extends from a body of said head.

3. A golf club as set forth in claim 1 wherein said inclined sighting surface is recessed in said head.

4. A golf club having a shaft and a putter head, which head comprises:

a striking surface having a first plane;

a base or bottom having a second plane wherein an intersection of said first and said second planes form a first angle;

an inclined sighting surface adjacent to and facing toward said striking surface having a third plane which extends from said first or second planes and forms a second, acute angle less than said first angle; and said inclined sighting surface is incremented with a plurality of notches wherein each notch is generally parallel with said base or said striking surface.

5. A golf club as set forth in claim 4 wherein said inclined sighting surface extends from a body of said putter head.

6. A golf club as set forth in claim 4 wherein said inclined sighting surface is recessed in said putter head.

* * * * *